United States Patent [19]

Bertrams

[11] Patent Number: 4,573,313

[45] Date of Patent: Mar. 4, 1986

[54] METHOD AND APPARATUS FOR FEEDING A DOSED MIXTURE OF SPLICING AIR AND LIQUID INTO THE SPLICING CHAMBER OF A COMPRESSED-AIR YARN SPLICING DEVICE

[75] Inventor: Josef Bertrams, Wegberg, Fed. Rep. of Germany

[73] Assignee: W. Schlafhorst & Co., Monchen-Gladbach, Fed. Rep. of Germany

[21] Appl. No.: 662,964

[22] Filed: Oct. 19, 1984

[30] Foreign Application Priority Data

Oct. 19, 1983 [DE] Fed. Rep. of Germany ..... 3337895

[51] Int. Cl.[4] ..... B65H 69/02; B65H 69/06; D01H 15/00

[52] U.S. Cl. ..... 57/22

[58] Field of Search ..... 57/22, 23, 261, 263, 57/350, 908, 250, 251

[56] References Cited

U.S. PATENT DOCUMENTS

| | | | |
|---|---|---|---|
| 3,070,947 | 1/1963 | Toledo et al. | 57/22 |
| 3,407,583 | 10/1968 | Irwin et al. | 57/22 |
| 3,619,868 | 11/1971 | Dibble | 57/22 X |
| 3,643,417 | 2/1972 | Irwin | 57/22 X |
| 3,867,810 | 2/1975 | Meertens et al. | 57/22 X |
| 4,397,139 | 8/1983 | Wey et al. | 57/22 |

*Primary Examiner*—Donald Watkins

*Attorney, Agent, or Firm*—Herbert L. Lerner; Laurence A. Greenberg

[57] ABSTRACT

A method for feeding a dosed mixture of splicing air and liquid into a splicing chamber of a compressed-air splicing device, including a valve movable from a receiving to an operating position upon receiving a splicing signal, the valve having a dosing chamber determining the quanity of splicing liquid by the volume thereof, and a mixing chamber, and an element containing a liquid supply, includes connecting the dosing chamber to the element containing the liquid supply prior to splicing for injecting a dosed quantity of liquid into the splicing chamber, disconnecting the dosing chamber from the element containing the liquid supply by moving the valve from the receiving to the operating position with the splicing signal, connecting the dosing chamber to the mixing chamber, and simultaneously opening the mixing chamber for the passage of splicing air to the splicing chamber, and an apparatus for carrying out the method.

5 Claims, 4 Drawing Figures

METHOD AND APPARATUS FOR FEEDING A DOSED MIXTURE OF SPLICING AIR AND LIQUID INTO THE SPLICING CHAMBER OF A COMPRESSED-AIR YARN SPLICING DEVICE

The invention relates to a method and an apparatus for feeding a dosed mixture of splicing air and liquid into the splicing chamber of a pneumatic air splicing device by means of a valve which releases the splicing air when it receives a signal.

As is known, the purpose of compressed-air splicing devices is to join together two or more yarns by loosening the fibers in the yarns and joining the fibers thus loosened of the two ends, with a splice by means of one or more blasts of compressed air. To achieve better success in making such spliced joints and to make spliced joints more durable or better in appearance, a small quantity of liquid can be added to the splicing air, when yarns made from certain types of fibers are spliced. The problem is here, to dose this small quantity of liquid very accurately, to atomize it and to introduce it into the splicing chamber together with the splicing air, which is also dosed.

The object of the invention is to introduce, in a simple manner, a very accurately dosed small quantity of liquid, well distributed, into the splicing air, which is dosed at the same time, and to feed the mixture so dosed to the splicing chamber.

With the foregoing and other objects in view there is provided, in accordance with the invention, a method for feeding a dosed mixture of splicing air and liquid into a splicing chamber of a compressed-air splicing device, including a valve movable from a receiving to an operating position upon receiving a splicing signal, the valve having a dosing chamber determining the quantity of splicing liquid by the volume thereof, and a mixing chamber, and an element containing a liquid supply, which comprises connecting the dosing chamber to the element containing the liquid supply prior to splicing for injecting a dosed quantity of liquid into the splicing chamber, disconnecting the dosing chamber from the element containing the liquid supply by moving the valve from the receiving to the operating position with the splicing signal, connecting the dosing chamber to the mixing chamber, and simultaneously opening the mixing chamber for the passage of splicing air to the splicing chamber.

The advantage involved in the invention consists, in particular, in that a well dosed mixture is obtained, in which there is always the same quantity of liquid irrespective of the quantity of splicing air fed, or the duration of the splicing air feeding cycle. In this process, the splicing chamber always receives only the mixture of splicing air and liquid, not, however, the splicing air alone. An advantage is, that right from the beginning there is no separation of the two components, nor is there any possibility of the components being separated during the process.

In order to carry out the method there is provided an apparatus for feeding a dosed mixture of splicing air and liquid into a splicing chamber of a compressed-air splicing device, comprising an element containing a liquid supply, a splicing air supply system, and a multi-way switch connected between the splicing air supply system and the splicing chamber, the switch being switchable from a receiving position to an operating position for releasing splicing air upon receiving a signal, the switch including a dosing chamber connected to the element containing the liquid supply in the receiving position, and the switch including a mixing chamber permitting the passage of splicing air in the operating position, the dosing chamber being disconnected from the element containing the liquid supply and connected to the mixing chamber in the operating position, and the dosing chamber permitting splicing air flowing through the mixing chamber to pass through the dosing chamber in the operating position.

In accordance with another feature of the invention, (a) the multi-way switch is a multi-way valve having a body and a piston longitudinally slideably mounted in the body and shiftable from the receiving position into the operating position;

(b) the body has at least three connecting apertures formed therein;

(c) the piston has two recesses formed therein in the form of a first recess and a second recess, the first recess forming the dosing chamber and the second recess forming part of the mixing chamber;

(d) the body has two recesses formed therein in the form of a first and a second recess, the first recess in the body being connected with the first recess in the piston in the receiving position, and the second recess in the body also forming part of the mixing chamber and being connected with the second recess in the piston, in the operting position, the first recess in the piston being connected through the second recess in the body with the second recess formed in the piston;

(e) the first recess in the body is connected through the first connecting aperture to the element containing the liquid supply;

(f) the second recess in the body is selectively connectible through the second connecting aperture to the splicing air supply system and the splicing chamber; and (g) the third connecting aperture is closed in the receiving position and is connected through the second recess in the piston to the second recess in the body in the operating position.

In accordance with a further feature of the invention, the body has a cylindrical inside space and the recesses formed therein are annular, and the piston is also cylindrical and the recesses formed therein are also annular.

In accordance with a concomitant feature of the invention, the multi-way switch is provided with an electromagnetically-actuated servo-valve.

In the zero position of the valve, the dosing chamber is already filled with liquid. The dosing of the liquid, however, is carried out only during the change-over of the valve. The quantity of liquid dosed is added, in the mixing chamber of the valve, to the splicing air which is released at the same time, so that the ready dosed mixture leaves the valve. The dosing chamber and mixing chamber are arranged inside the valve, but they could just as well be arranged outside.

The valve is actuated when the signal is received that splicing shall be carried out. It can be operated by hand or automatically, preferably by means of an electromagnetically operated servovalve, which can be integrated in the valve.

Examples of an embodiment of the invention are illustrated in the drawings. The invention is described and explained in detail, by reference to these examples of an embodiment.

Figure 1:
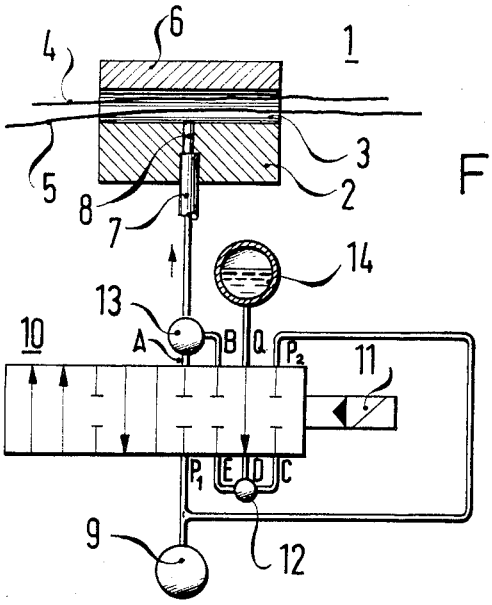
FIG. 1 shows schematically a first example of embodiment of the invention.

The splicing chamber 1 of a compressed-air splicing device according to the example of a first embodiment of the invention is shown in FIG. 1. It consists of a splicer head 2 which is provided with a channel 3, in which there are the two yarns 4, 5, to be spliced together. The channel 3 is closed with a lid 6. A tube 7 is connected to the splicer head 2 and has its mouth at a vent 8.

A multiple way valve 10, which can be switched over from a receiving position, or basic position, into a mixing position, or operating position, is interposed between the splicing air supply system 9 and the splicing chamber. This multiple way valve 10 is provided with an electromagnetically operated servo-valve 11, which, when the signal for splicing is given, receives an impulse and then changes over the multiple way valve from the basic position, as shown in the drawing on the right, to the operating position, as shown in the drawing on the left.

The multi way valve 10 has eight connecting apertures, which are marked with letters, or letters in conjunction with indices. It contains a smaller sized dosing chamber 12 and a larger sized mixing chamber 13.

In the basic position, the dosing chamber 12 is connected, via the connecting apertures D and Q, to an element 14 containing the liquid supply. This element can, for example, be a container, a pipe, or the like. The mixing chamber 13 is connected with the splicing chamber 1 through the tube 7. The splicing air supply is still blocked. The splicing air supply system 9 can be an air-compressor, a system of tubes through which compressed air passes, a pressure reducing valve, or the like.

As soon as the splicing signal is given to the servo-valve 11, the multiple way valve 10 is changed over and the connections of the connecting apertures are thereby changed. FIG. 1 shows, that in the operating position, the dosing chamber 12 is disconnected from the connecting aperture D and, consequently, from the element 14. On the other hand, the connecting aperture P2 is now connected, via the connecting aperture C, with the dosing chamber 12, and the connecting aperture E and the connecting aperture B are connected with the mixing chamber 13. Also, the connecting aperture P1 is connected, through the connecting aperture A, with the mixing chamber 13. In this way, a portion of the splicing air is fed directly into the mixing chamber 13 while another portion of the splicing air makes its way to the mixing chamber 13 via the dosing chamber 12. This latter portion of the splicing air carries along with it the dosed quantity of liquid contained in the dosing chamber 12, and the final mixing of air and liquid is carried out in the mixing chamber 13. The mixture passes through the tube 7 to the splicing chamber 1 to be available there for the splicing of the two yarns 4, 5.

Figure 2:
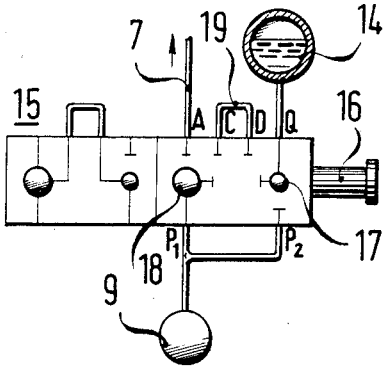
FIG. 2 shows a second example of an embodiment of the invention.

In the example of a second embodiment of the invention, shown in FIG. 2, the valve used is also a multiple way valve 15. This multiple way valve, too, can be changed over into two positions by a manually operated system 16. The splicing signal is in this case given by hand. The multiple way valve 15 is provided with altogether 6 connecting apertures, plus one dosing chamber 17 and one mixing chamber 18.

In the basic position or dosing position, the dosing chamber 17 is connected, via the connecting aperture Q, with the element 14 containing the liquid supply. At the same time, the splicing air supply system 9 is connected, via the connecting aperture P1, to the mixing chamber 18. A connecting tube 19 establishes direct communication between the two connecting apertures C and D. The tube 7, which terminates at the connecting point A, is in the basic position closed by the valve.

When the manual operating system 16 is acutated, the multiple way valve 15 is changed over, whereby the dosing chamber 17 is disconnected from the connecting aperture Q, and consequently, from the element 14. There is, however, now, in the operating position, a connection between the connecting aperture P2 and the mixing chamber 18 via the dosing chamber 17 and the connecting apertures D and C. Also, the connecting aperture P1 is connected to the splicing chamber via the mixing chamber 18 and the connecting aperture A. Consequently, part of the splicing air passes directly into the mixing chamber 18, while another part makes its way to the mixing chamber via the dosing chamber 17, where it carries along with it the quantity of liquid that has already been dosed and which it delivers, together with the splicing air, to the mixing chamber 18. There, the final mixing is carried out and the mixture is then passed on, via the tube 7, to the splicing chamber 1.

Figure 3:
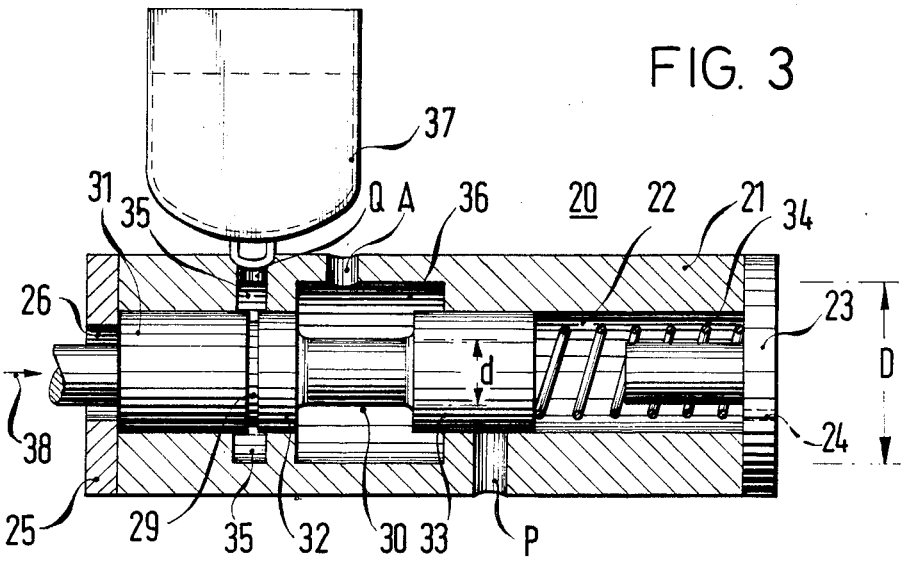
FIGS. 3 and 4 show a sectional view of a valve as provided in the invention.
Figure 4:
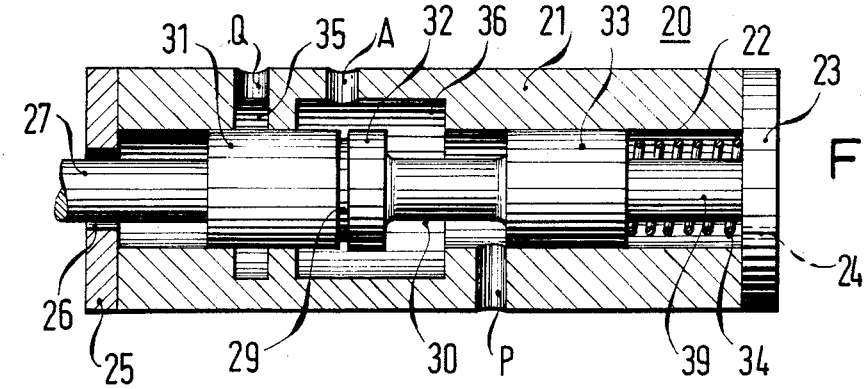

In the example of a third embodiment, shown in FIGS. 3 and 4, the multiple way valve 20, as a whole marked with 20, has a body 21 with a cylindrical inside space 22 of the same diameter all through. The inside space 22 is on its right hand side closed with a lid 23, which is provided with a vent 24. On the left hand side, the inside space 22 is closed with a ring-shaped disk 25, which has a central opening 26 for the passage of a piston rod 27.

A piston, also cylindrical in shape and slideable axially, is mounted in the cylindrical opening 22 in such a way, that it seals off the interior space. The piston is provided with two annular recesses 29 and 30, so that the piston is divided into three sections 31, 32 and 33.

In the basic position, as shown in FIG. 3, a pressure spring 34 positioned between the lid 23 and the piston section 33, has pushed the piston to the left so that the piston section 31 rests against the disc 25.

The first recess 29 of the piston serves as a dosing chamber, the second recess 30 is part of the mixing chamber. The other part of the mixing chamber is formed by an annular recess 36 in the body and which forms part of the interior space 22. Another annular recess 35 of the body 21 is so arranged that in the basic position, it is in connection with the dosing chamber 29 and encircles this dosing chamber like a ring. The other recess 36 of the body 21 is so arranged that in the basic position of the valve, it encircles the recess 30 of the piston like a ring.

The multiple way valve 20 has three connecting apertures marked with P, A and Q.

In the basic position, or the dosing position, as shown in FIG. 3, the first recess 29 of the piston is connected, via the first recess 35 of the body and via the connecting aperture Q, to an element 37 containing the liquid supply and having the form of a container. The container 37 is positioned very close to the connecting aperture Q. In the drawing, the connecting aperture A, for the sake of clarity of presentation, is shown as lying in the same axial sectional-plane as the connecting aperture Q. In fact, however, it lies in a different axial sectional-plane, which means that the distance between the connecting apertures A and Q is somewhat greater. The connecting aperture A leads to a splicing chamber not illustrated here, so that the splicing chamber is permanently connected to the mixing chamber 30, 36. A splicing air supply system not illustrated here is connected to the connection aperture P.

Whan the signal is given that splicing shall be carried out, the piston rod 27 is moved in the direction shown by the arrow 38, until the operating position, as shown in FIG. 4, of the multiple way valve 20 has been reached. In this operating position, the face of the right hand piston section 33 butts against a stop 39 which is fixed to the lid 23. While the piston is moving, the dosing chamber 29 moves away from the annular space 35, carrying along with it, in its annular space, liquid in a quantity determined by its volume, and feeding this liquid into the mixing chamber, as is shown in FIG. 4. The piston section 33 has now been moved to the side so much, that the connecting aperture P is connected with the mixing chamber 30, 36. The splicing air now enters the mixing chamber through the connecting aperture P and, as it does so, also passes through the dosing chamber 29, from where it carries away the dosed quantity of liquid.

The mixture is fed, through the connecting aperture A, to the splicing head.

After a certain time interval, which can also be adjustable, the thrust bearing on the piston rod in the direction shown by the arrow 38 is neutralized and the compressed pressure spring 34 pushes the piston towards the left side again, to bring the piston section 31 again to rest against the disc 25.

If desired, the funtions of the connecting apertures A and B can be interchanged. In this case, the splicing air supply system will be connected to the connecting aperture A, and the splicing chamber will be connected to the connecting aperture P. While there would then be a constant over-pressure in the mixing chamber 30, 36, the dosing chamber 29 would, in the operating position, come to lie directly under that connecting aperture, through which the splicing air enters, which could have a beneficial effect on the formation of the mixture.

The invention is not limited to the examples of embodiments which are described and illustrated here.

To facilitate manufacture, the piston sections 31, 32, 33 could have the form of threaded rings, aligned on a one-piece piston rod having the diameter D, which would make for easy positioning or adjustment of the recesses 29 and 30. Similarly, the recesses in the body could be obtained by boring into the body a hole having the diameter D and inserting into the bore rings spaced apart from each other, the recesses being in this case formed by the distances of the rings from one another.

I claim:

1. Method for feeding a dosed mixture of splicing air and liquid into a splicing chamber of a compressed-air splicing device, including a valve movable from a receiving to an operating position upon receiving a splicing signal, the valve having a dosing chamber determining the quantity of splicing liquid by the volume thereof, and a mixing chamber, and an element containing a liquid supply, which comprises connecting the dosing chamber to the element containing the liquid supply prior to splicing for injecting a dosed quantity of liquid into the splicing chamber, disconnecting the dosing chamber from the element containing the liquid supply by moving the valve from the receiving to the operating position with the splicing signal, connecting the dosing chamber to the mixing chamber, and simultaneously opening the mixing chamber for the passage of splicing air to the splicing chamber.

2. Apparatus for feeding a dosed mixture of splicing air and liquid into a splicing chamber of a compressed-air splicing device, comprising an element containing a liquid supply, a splicing air supply system, and a multi-way switch connected between said splicing air supply system and the splicing chamber, said switch being switchable from a receiving position to an operating position for releasing splicing air upon receiving a signal, said switch including a dosing chamber connected to said element containing the liquid supply in said receiving position, and said switch including a mixing chamber permitting the passage of splicing air in said operating position, said dosing chamber being disconnected from the element containing the liquid supply and connected to the mixing chamber in the operating position, and said dosing chamber permitting splicing air flowing through said mixing chamber to pass through said dosing chamber in said operating position.

3. Apparatus according to claim 2, wherein:

(a) the multi-way switch is a multi-way valve having a body and a piston longitudinally slideably mounted in said body and shiftable from said receiving position into said operating position;

(b) said body has at least three connecting apertures formed therein;

(c) said piston has two recesses formed therein in the form of a first recess and a second recess, said first recess forming said dosing chamber and said second recess forming part of said mixing chamber;

(d) said body has two receses formed therein in the form of a first recess and a second recess, said first recess in said body being connected with said first recess in said piston in said receiving position, and said second recess in said body also forming part of said mixing chamber and being connected with said second recess in said piston, in said operating position, said first recess in said piston being connected through said second recess in said body with said second recess formed in said piston;

(e) said first recess in said body is connected through said first connecting aperture to said element containing the liquid supply;

(f) said second recess in said body is selectively connectible through said second connecting aperture to said splicing air supply system and said splicing chamber; and (g) said third connecting aperture is closed in said receiving position and is connected through said second recess in said piston to said second recess in said body in said operating position.

4. Apparatus according to claim 3, wherein said body has a cylindrical inside space and said recesses formed therein are annular, and that piston is also cylindrical and said recesses formed therein are also annular.

5. Apparatus according to claim 2, wherein said multi-way switch is provided with an electromagnetically-actuated servo-valve.

* * * * *